United States Patent [19]

Lazar

[11] Patent Number: 4,589,685

[45] Date of Patent: May 20, 1986

[54] CHANGEABLE LABELLING SYSTEM

[76] Inventor: Allan Lazar, 1516 Baylor Ave., Rockville, Md. 20850

[21] Appl. No.: 637,154

[22] Filed: Aug. 2, 1984

[51] Int. Cl.[4] ..... B42D 15/00; B42D 5/00; B43L 1/12

[52] U.S. Cl. ..... 283/81; 281/15 R; 434/410

[58] Field of Search ..... 281/15 R, 15.5, 30, 281/37; 434/410; 283/81

[56] References Cited

U.S. PATENT DOCUMENTS

| | | | |
|---|---|---|---|
| 2,697,884 | 12/1954 | Dechert | 434/410 |
| 2,755,576 | 7/1956 | Golden | 281/15 R |
| 2,894,336 | 7/1959 | Thorner | 434/410 |
| 3,149,426 | 9/1964 | Kaeyer | 434/410 |
| 3,279,100 | 10/1966 | Knott | 434/410 |
| 4,051,609 | 10/1977 | Boursaw | 434/410 |

FOREIGN PATENT DOCUMENTS

| | | | |
|---|---|---|---|
| 579560 | 10/1924 | France | 434/410 |
| 2055702 | 3/1981 | United Kingdom | 434/410 |

*Primary Examiner*—Paul A. Bell
*Assistant Examiner*—Paul M. Heyrana
*Attorney, Agent, or Firm*—Eric P. Schellin

[57] ABSTRACT

The invention is directed to a changeable labelling system wherein a readily changeable label is secured to an article to be labelled. In the first embodiment an impression surface having overlaying adhering translucent and protective transparent sheets provides a readily changeable label that can be secured to an article in a variety of ways. In addition, in an alternate embodiment a readily erasable surface is secured to the article to be labelled and a protective sheet overlays the surface to prevent inadvertent erasure.

8 Claims, 8 Drawing Figures

CHANGEABLE LABELLING SYSTEM

BACKGROUND OF THE INVENTION

1. Field of the Invention

The invention is related to readily changeable labelling systems wherein indicia bearing labels can be readily erased and changed. The invention is more specifically directed to a label utilizing a "magic slate" to provide the indicia bearing portion of the label. However an alternate embodiment is disclosed utilizing a protected easily erasable surface.

2. Description of the Prior Art

Presently most articles are labelled with fixed or relatively unchangeable labels. In some applications however a changeable label is desirable, in that the contents of the article or the status of the article has changed. One application in which this invention provides particular usefulness is providing a changeable label for video or audio cassettes, or cassette holders.

Video or audio cassettes can be used over and over to tape various events and programs, and as such, a changeable labelling system is very important to the user so that he or she can identify the program now recorded on the cassette. At the present time most users use adhesive paper strips that are secured to the cassette or holder. The location and identification of the program on the cassette is written on the strip so that a user may readily identify the contents of the cassette. When the tape is erased and another program recorded on the cassette the original indica on the tape must be crossed out, erased or another paper strip applied to the cassette holder. The present invention simplifies the changing of identifying indicia on articles such as cassettes or cassette holders.

Reusable erasable memo pads have been widely known and are primarily used in toys and novelties. Such pads are called "magic slates" and generally comprise a clay, putty or wax impression surface which is impregnated with an oil and is overlayed with a translucent sheet, see U.S. Pat. No. 1,455,579. A pointed instrument similar to a pencil is used to apply pressure to the translucent sheet and the sheet adheres to the impression surface creating a visible mark on the translucent sheet. The mark can be erased by lifting the translucent sheet away from the impression surface thereby breaking the adhesion and erasing the sheet.

Although "magic slates" have been principally used in toys, other more utilitarian uses have been considered. Generally, these uses have been directed to memo pads and record books wherein temporary notations must be jotted down, see U.S. Pat. Nos. 2,198,095, 2,663,095, 2,997,884 and 3,579,871. "Magic slates" have been used in switchboard message pads, wherein a single impression surface and a plurality of translucent sheets are secured to a mounting plate which is mounted over the switchboard, see U.S. Pat. No. 2,818,662. Transparent protective sheets are usually provided to overlay the translucent sheet and protect the recorded indicia.

Simplified erasure means have also been proposed which simplify the erasure operation. Some erasure means comprise slides which can be moved between the translucent sheet and the impression surface to separate the sheet from the surface erasing recorded indicia, see U.S. Pat. No. 4,011,665. Such slide erasure means can be used to control individual translucent sheets independently or adjacent translucent sheets thereby providing independent erasable pads, as illustrated in U.S. Pat. No. 2,894,336. Another form of erasure means is a pneumatically operated system wherein an air blast is used to separate the translucent sheet from the impression surface, see U.S. Pat. Nos. 3,943,643 and 4,051,609. U.S. Pat. Nos. 1,881,140, 2,359,195 and 2,404,563, disclose erasure means in which the impression surface is pulled away from the adhering indicia bearing sheets.

Writing surfaces having easily erasable surfaces are also known. Presently a memo board having a readily erasible surface is marketed by Freelance, Inc., of Willow Grove, Pa. Generally, felt tip pens are used to inscribe these boards with easily erasable indicia.

SUMMARY

The present invention uses a "magic slate" label to provide a changeable labelling system so that indicia noting the contents, status, nature and other characteristics of an article can be readily changed. The "magic slate" comprises an impression surface which is overlayed with a translucent adhering sheet, which in turn is overlayed with a transparent protective sheet. The "magic slate" label is provided with an attaching means for attaching the label to an article to be labelled. In one embodiment the attaching means comprises a contact adhesive and in the other a sheath that is mechanically secured to the article to be labeled. The "magic slate" label may also be formed integrally with the exterior surface of the article.

Another changeable labelling system is disclosed wherein a reusable writing surface is provided on which indicia can be written by an erasable writing instrument. The writing surface is protected by a transparent sheet so that the indicia can not be inadvertently wiped off. When the writing surface is to be erased the protective sheet is lifted from the surface and the writing wiped off.

DETAILED DESCRIPTION

Figure 1:
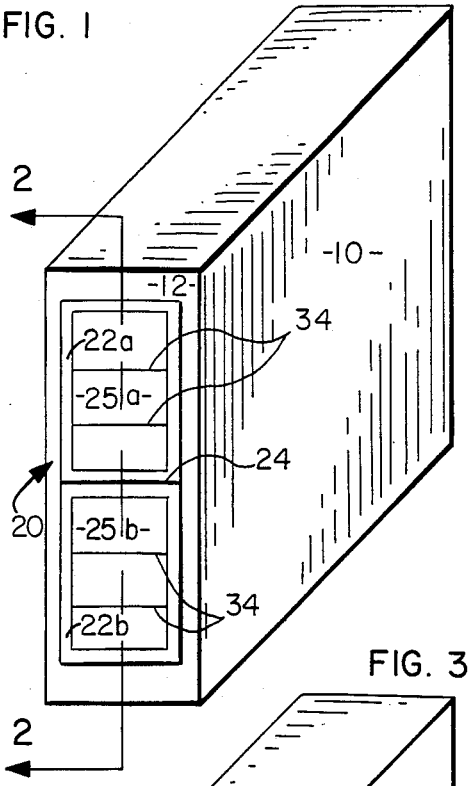
FIG. 1, is a perspective view of the "magic slate" label on a video cassette or cassette holder.

The present invention is a changeable labelling system that can be used on a multitude of articles. Although the invention is described as being used on a video cassette or cassette holder, this invention is by no means limited in its application.

Video cassette or cassette holder 10 is provided with a "magic slate" label 20 on its spine or edge side 12 of the holder. Hereinafter, the term holder will be used to describe the video cassette or cassette holder 10 but it will be apparent that the defined holder is interchangeable with the term video cassette. The label is provided with cardboard or plastic borders **22*a* and 22*b* which are joined at horizontal hinge 24 and form indicia bearing surfaces 25*a* and 25*b*. Hinge 24 is simply a fold line in the border. The border is secured to transparent plastic sheets 26***a* and 26*b* which overlays flexible translucent adhering sheets 28*a* and 28*b*. The adhering sheets overlay impression surface 30 which comprises support backing 31 formed of cardboard or plastic, and covered with a waxy or tacky covering substance 33. The waxy covering substance as well as the support backing and the adhering sheets may be formed from any particular material that is appropriate to a "magic slate". The impression surface is secured to the container 10 by attaching means 32 which in this embodiment comprises an adhesive layer for adhesively securing the impression surface to the holder.

The waxy or tacky covering substance may be applied to the adhering sheet and the impression surface merely comprise an opaque background. The slate would function in the same way only the waxy or tacky layer would be reversed.

Figure 2:
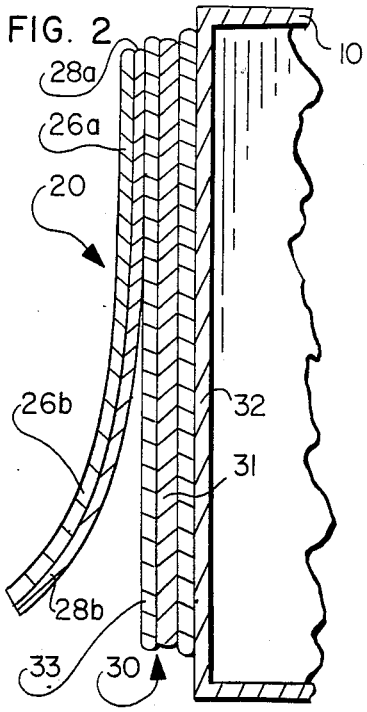
FIG. 2, is a cross section view along line 2—2.

Indicia bearing surfaces 25*a* and 25*b* are pivotted from top-to-bottom and bottom-to-top respectively to thereby separate the translucent sheet from the impression surface and erase the recorded indicia. Depending upon the application however, the indicia bearing surfaces can be opened left-to-right or vice versa. As illustrated in FIGS. 1 and 2 indicia bearing surface 25*a* is in a marked configuration and adhering sheet 28*a* is stuck to the impression surface providing a visible mark. Surface 25*b* is in the erased configuration in that translucent sheet 28*b* is separated from the impression surface. Either the transparent plastic covering sheet, the borders if present, the impression surface or the translucent adhering sheet may be provided with lines 34 to guide marking of indicia on the slate. Instead of lines, different colored areas, numbers, letters or other indicia maybe marked on the slate to act as guides.

The hinged translucent and protective sheets are vertically oriented about horizontal hinge 24 to prevent inadvertent erasure of the label by a person pulling the holder from a group of holders. Typically a person grips the narrow side of the holder when removing the holder from a group, therefore if a person's fingers slips a horizontal force maybe exerted on the label causing the translucent sheet to separate from the impression member if the label was horizontally oriented. It should be noted that the hinges for the slate could be vertically oriented if desired and could be protected by making the slate narrower than the holder.

The embodiment illustrated in FIGS. 1 and 2 discloses a "magic slate" label having two indicia bearing surfaces 25*a* and 25*b*. A user may encode, on the different surfaces, the location of the programs on the tape cassette. By providing two surfaces if only a half segment of the cassette is erased or taped over only one of the indicia surfaces may need to be erased and the other corresponding to the other half segment can be preserved in its recorded condition. However as noted later on, any number of indicia bearing surfaces can be employed depending upon the particular application.

Figure 3:
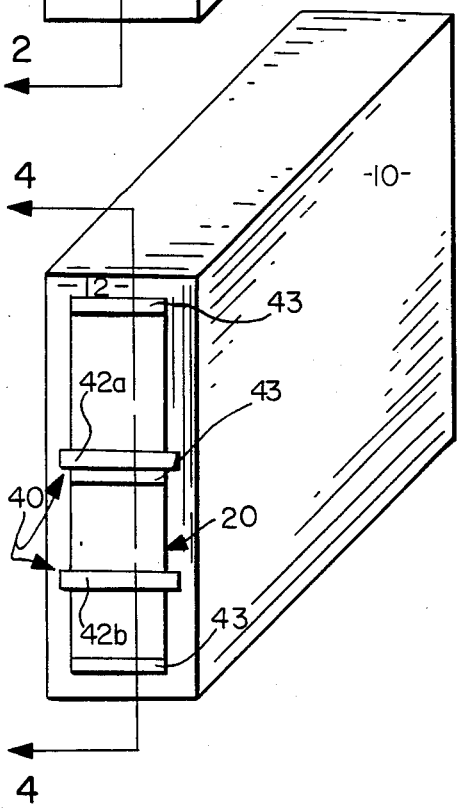
FIG. 3, is a perspective view of another embodiment of the "magic slate" label.
Figure 4:
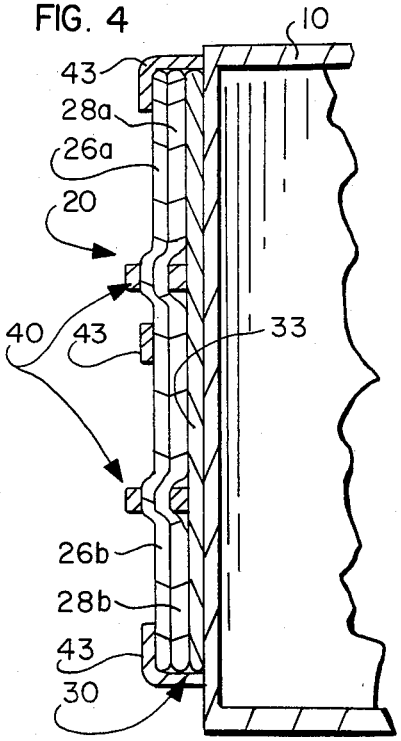
FIG. 4, is a cross section view along line 4—4.

FIGS. 3 and 4 illustrate an alternate embodiment of the "magic slate" label, wherein the label is provided with erasure means 40. Erasure means 40 comprises slides 42*a* and 42*b* which are cardboard or plastic strips wrapped around the protective sheet and the translucent adhering sheet. Instead of cardboard strips a string assembly could also be used to slide between the impression surface and the adhering sheet to separate and erase the adhering sheet. By sliding the slides along the slate, adhering sheets 28*a* and 28*b* and impression surface 30 is separated thereby erasing indicia recorded on the label. As is readily apparent the two indicia bearing surfaces are independently erasable by the respective slide. The top and bottom edges of the label together with the middle of the label are secured by tape 43 that maybe stapled to hold the edges and middle of the label in place. Any of a number of sliders and slider configurations can be employed as desired.

In addition to the erasure means, the embodiment illustrated in FIGS. 3 and 4 is also unique in that it is made integrally with the holder and is not provided with an attaching means. Namely the backing for the impression surface is formed by the end edge of the box with the remaining elements of the label added thereon.

Figure 5:
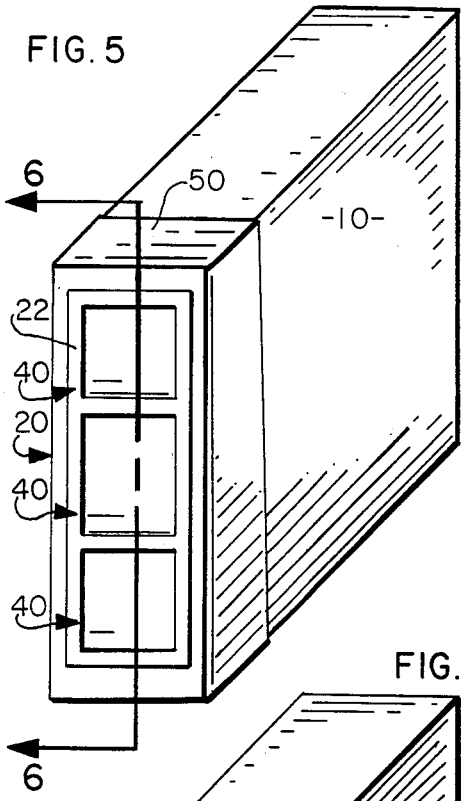
FIG. 5, is a perspective view of another embodiment of the "magic slate" label.
Figure 6:
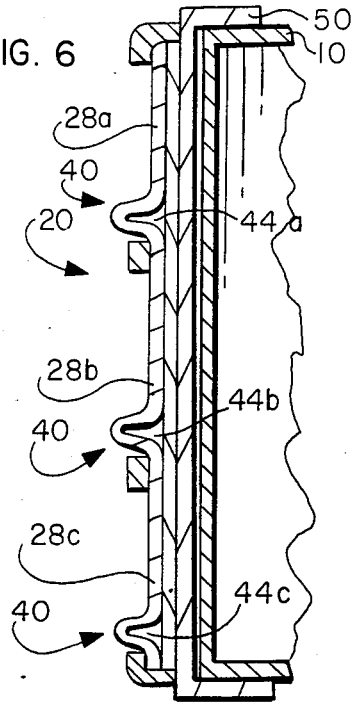
FIG. 6, is a cross section view along line 5—5.

The embodiment illustrated in FIGS. 5 and 6 disclose another embodiment of the "magic slate" label, illustrating another embodiment of erasure means 40. The erasure means of this embodiment includes penumatic operating means 44*a*, 44*b* and 44*c* which uses an air blast to separate the adhering sheet from the impression surface. More specifically, the edges of the label are tightly sealed by border 22 and air pockets 44*a*, 44*b* and 44*c* comprising the pneumatic operating means are formed between the adhering sheet and the impression surface. By pressing on the air pocket the air contained therein is blasted between the adhering sheet and the impression surface resulting in a separation of the sheets and erasure of the recorded indicia. The air pockets can be selectively activated to erase individual indicia bearing surfaces independently of one another.

In addition to the two erasure means disclosed above a third erasure means, that is not illustrated, but which could be used in the present invention comprise a stick that is placed between the adhering sheet and the impression surface wherein the stick maybe rolled or moved by a fulcrum to separate the adhering sheet from the impression surface thereby erasing the label.

As will be readily apparent from FIGS. 5 and 6 the "magic slate" label of this embodiment is attached on sheath 50 which is mechanically secured by friction to holder 10. The sheath is formed from a relatively rigid material such as plastic that engages the sides, top and bottom of the holder to properly position the label on the holder. Please note that the sheath can be formed into any appropriate configuration as defined by the article to which it is to be secured.

All of the above described embodiments are directed to a "magic slate" label which is secured to the holder in a variety of ways and having various erasure means. The various "magic slate" label embodiments can be interchanged with any of the disclosed mounting structures. Therefore the erasure means is not limited to any particular mounting structure and any of the specific erasure means can be adapted to any of the mounting surfaces. In addition, the number of indicia bearing surfaces is not limited to one, two or three but may comprise any number of surfaces as required by the ultimate use.

Figure 7:
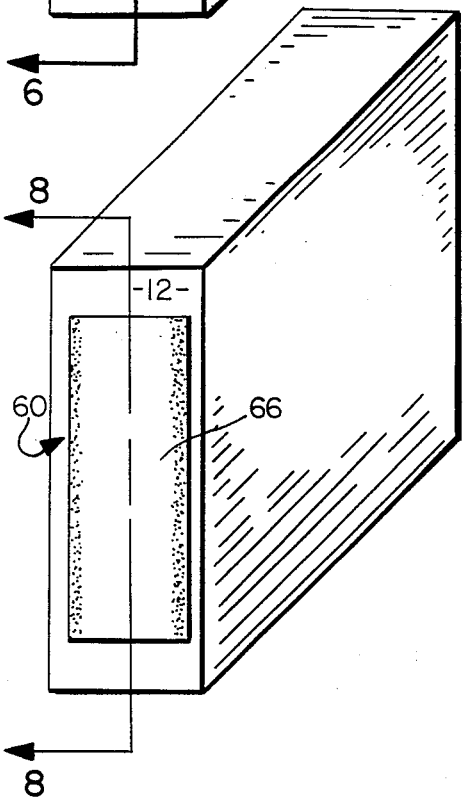
FIG. 7, is a perspective view of another embodiment of the readily changeable label.
Figure 8:
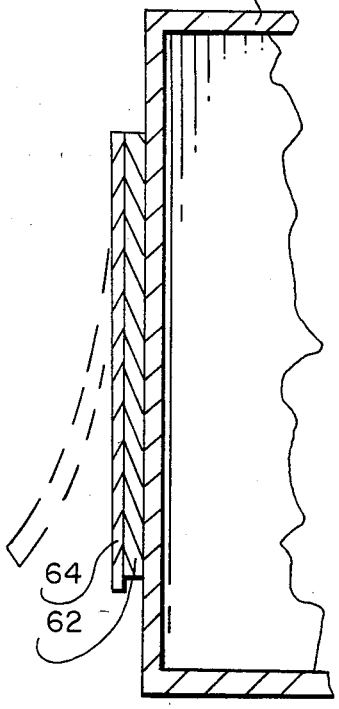
FIG. 8, is a cross section view along line 6—6.

The embodiment illustrated in FIGS. 7 and 8 is not directed to a "magic slate" label but is directed to a changeable label of similar design. This embodiment comprises label 60 which as before is secured to the end edge 12 of holder 10. The label maybe secured to the holder in any of the above described ways and is not limited to any of the ways described. The label comprises readily erasable surface 62 which maybe formed of a slick plastic, vinyl, "Formica", porcelain enamel or other similar surface; and protective sheet 64 which is provided with tacky substance 66 around its interior outside edge or around the exterior outside edge of base 62, to thereby secure the protective sheet to the erasable surface. "Formica" is a trademark of the American Cyanamid Corporation. The top edge of sheet 64 is secured to either the end edge of the holder or the erasable surface so that it may be pivotted as indicated in phantom lines in FIG. 8. The protective sheet is transparent and prevents inadvertent erasure of the erasable surface. When the surface is to be erased the protective sheet is lifted from the erasable surface and the recorded indicia wiped off and new indicia reinscribed. The indicia can be inscribed with a felt tip pen or other appropriate writing implement that can be easily erased.

The last embodiment illustrated in FIGS. 7 and 8, may incorporate refinements discussed above in regards to the earlier embodiments. Such refinements may include providing this embodiment with a border on the transparent sheet; and further providing this embodiment with guides formed from lines, colored areas or indicia. This embodiment may comprise more than one indicia bearing surface similar to the previously described embodiments. The invention is not to be solely limited to the above described embodiments, but is to be limited only to the claims that follow.

I claim:

1. A labelling system for a video cassette or video cassette holder, wherein indicia recorded on the label can be changed as required, the labelling system comprising:

an impression layer having a first planar surface and a second planar surface, the first planar surface defining a surface for recording indicia;

a flexible translucent adhering sheet overlaying the first planar surface of the impression layer which when pressed against the first planar surface the translucent adhering sheet adheres thereto leaving visible indicia, when the translucent adhering sheet is separated from the first planar surface of the impression layer the visible indicia disappears allowing additional indicia to be recorded.

the impression layer together with the flexibletranslucent adhering sheet form at least two indicia recording surfaces wherein each indicia recording surface represents a segment on a corresponding video cassette;

erasure means for independently erasing each of the at least two indicia recording surfaces by separating the adhering sheet from the first planar surface of the impression layer; and attaching means overlying at least a portion of the second planar surface of the impression layer, the attaching means is adapted and constructed to mount the labelling system on a spine of a video cassette or video cassette holder.

2. A labelling system as defined by claim 1 wherein the attaching means comprises an adhesive surface for adhesively securing the impression surface to an article to be labelled.

3. A labelling system as defined by claim 2 wherein the erasure means comprises a hinge means for the at least two adhering sheets each so that the adhering sheet can be independently hingedly separated from the impression surface each indicia recording surface is provided with a border to protect the translucent adhering sheet

4. A labelling system as defined by claim 2 wherein the erasure means comprises a slide means that is located between the impression surface and the adhering sheet for separating the surfaces and erasing recorded indicia.

5. A video cassette holder having a labelling system wherein indicia recorded on the labelling system can be changed as required, the video cassette holder comprising:

a container defining a space into which a video cassette can be stored, the container having at least one exposed side;

an impression layer formed integrally on the exposed side of the container, the impression layer having a first planar surface defining at least two indicia recording surfaces wherein each indicia recording surface represents a segment on a corresponding video cassette;

a flexible translucent adhering sheet overlaying the first planar surface of the impression layer which when pressed against the first planar surface, the translucent adhering sheet adheres thereto leaving visible indicia, when the translucent adhering sheet is separated from the firsst planar surface of the impression layer the visible indicia disappears allowing additional indicia to be recorded; and an erasure means for independently erasing each of the at least two indicia recording surfaces by separating the translucent adhering sheet from the first planar surface of the impression layer to erase indicia recorded thereon.

6. A labelling system as defined by claim 5 further comprising a transparent protective sheet which overlies the flexible translucent adhering sheet for protecting the recorded indicia.

7. A labelling system as defined by claim 6 wherein the erasure means comprises a hinge means for the adhering sheet so that the adhering sheet can be independently hingedly separated from the impression surface each indicia recording surface is provided with a border to protect the translucent adhering sheet.

8. A labelling system as defined by claim 6 wherein the erasure means comprises a slide means that is located between the impression surface and the adhering sheet for separating the surfaces and erasing recorded indicia.

* * * * *